US009074421B2

(12) United States Patent
Marica et al.

(10) Patent No.: US 9,074,421 B2
(45) Date of Patent: Jul. 7, 2015

(54) SELF-LOCKING TOP DRIVE GUIDE SYSTEM

(71) Applicant: NATIONAL OILWELL VARCO LLP, Houston, TX (US)

(72) Inventors: Adrian Marica, Cypress, TX (US); Mihai Ionescu, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 337 days.

(21) Appl. No.: 13/645,988

(22) Filed: Oct. 5, 2012

(65) Prior Publication Data

US 2014/0097027 A1 Apr. 10, 2014

(51) Int. Cl.

| | |
|---|---|
| ***E21B 19/00*** | (2006.01) |
| ***E21B 3/02*** | (2006.01) |
| ***E21B 7/02*** | (2006.01) |
| ***E21B 17/046*** | (2006.01) |
| ***E21B 19/15*** | (2006.01) |
| *E21B 19/10* | (2006.01) |
| *E21B 19/22* | (2006.01) |
| *E21B 19/24* | (2006.01) |

(52) U.S. Cl.

CPC . *E21B 3/02* (2013.01); *E21B 19/10* (2013.01); *E21B 19/22* (2013.01); *E21B 19/24* (2013.01); *E21B 19/00* (2013.01); *E21B 7/023* (2013.01); *E21B 17/046* (2013.01); *E21B 19/155* (2013.01)

(58) Field of Classification Search

CPC ..... E21B 7/023; E21B 3/02; E21B 19/115; E21B 15/00; E21B 19/06; E21B 19/08; E21B 19/16; E21B 19/18; E21B 19/00; E21B 19/02; E21B 19/22; E21B 19/24; B66C 1/00; B66D 1/36

USPC ..... 175/220, 162, 203, 103, 195; 166/379, 166/77.51, 77.52, 78.1, 380

See application file for complete search history.

(56) References Cited

U.S. PATENT DOCUMENTS

| | | | | |
|---|---|---|---|---|
| 5,381,867 | A | 1/1995 | Berry | |
| 5,921,329 | A | 7/1999 | Armstrong | |
| 6,024,181 | A | 2/2000 | Richardson et al. | |
| 6,951,082 | B2 | 10/2005 | Nelson et al. | |
| 7,188,686 | B2 | 3/2007 | Folk et al. | |
| 8,181,721 | B1 * | 5/2012 | Keast | 175/195 |
| 2004/0129417 | A1 | 7/2004 | Nelson | |
| 2011/0203820 | A1 | 8/2011 | Marcia | |

OTHER PUBLICATIONS

Search Report and Written Opinion dated Sep. 23, 2014 for corresponding International Application No. PCT/US2013/061167 (10 pgs.).

* cited by examiner

*Primary Examiner* — Yong-Suk (Philip) Ro

(74) *Attorney, Agent, or Firm* — Derek V. Forinash; Porter Hedges LLP

(57) ABSTRACT

A top drive guide system comprising first and second rail sections axially aligned to form a top drive guide rail. A locking member is coupled to the first rail section and is movable between a locked position and an unlocked position. A locking surface is disposed on the second rail section and is operable to engage the locking member when the locking member is in the locked position. An actuator is coupled to the locking member and is operable to move the locking member from the locked position to the unlocked position.

18 Claims, 18 Drawing Sheets

SELF-LOCKING TOP DRIVE GUIDE SYSTEM

CROSS-REFERENCE TO RELATED APPLICATIONS

None

BACKGROUND

This disclosure relates generally to methods and apparatus for guiding a top drive during operation. More specifically, this disclosure relates to a top drive guide system that utilizes an automatic or remotely actuated locking system to secure connections between consecutive sections of guide rail used to form the guide system.

Many drilling rigs utilize top drive units that connect to the uppermost end of the drill string to support the drill sting, provide the torque required to rotate the drill string, and provide a fluid conduit for the circulation of drilling fluids into the drill string. In order to provide this functionality, typical top drives include a drilling motor, pipe handling equipment, and pressure control devices integrated into a single unit. The top drive also includes a dolly, or carriage, that is mounted to a vertical rail, or guide system, that allows the top drive to move freely in a vertical direction but prevents rotation of the top drive as it is applying torque to the drill string and ensures that the top drive remains aligned with the wellbore.

Although some derricks have top drive guide systems permanently installed, many rigs utilize portable top drives that are installed and removed as needed. Installing a top drive guide system often includes assembling a plurality of short guide rail sections together to form a guide rail having the required height. Assembling these guide rail sections often includes hoisting individual guide rail sections into the derrick and utilizing personnel working at elevated positions to secure the connection between adjacent sections. This process can be time consuming and has to be repeated in the reverse to remove the guide system from the drilling rig.

Thus, there is a continuing need in the art for methods and apparatus for assembling and securing top drive guide systems that overcome these and other limitations of the prior art.

BRIEF SUMMARY OF THE DISCLOSURE

A top drive guide system comprising first and second rail sections axially aligned to form a top drive guide rail. A locking member is coupled to the first rail section and is movable between a locked position and an unlocked position. A locking surface is disposed on the second rail section and is operable to engage the locking member when the locking member is in the locked position. An actuator is coupled to the locking member and is operable to move the locking member from the locked position to the unlocked position.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
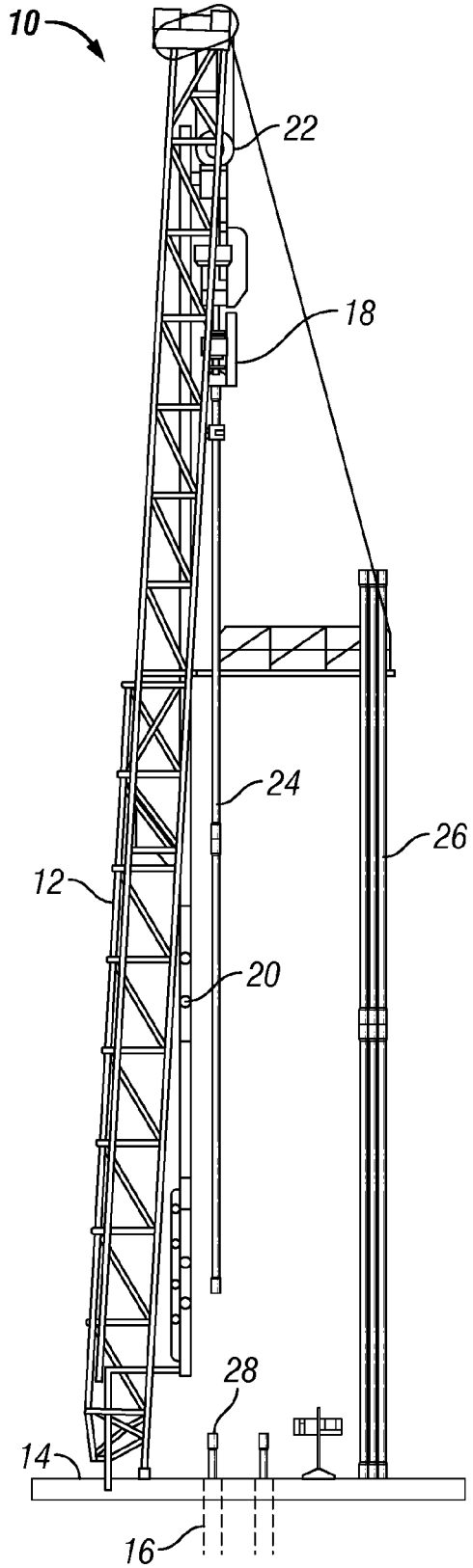
FIG. 1 is a partial elevation view of a drilling rig utilizing a top drive and top drive guide rail system.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a drilling rig 10 includes a derrick 12 extending upward from a drill floor 14 and a wellbore 16 extending downward from the drill floor 14. The drilling rig 10 is equipped with a top drive 18 that is supported by the rig's hoisting system (not shown) via a traveling block 22. The top drive 18 is also coupled to the derrick 12 by a top drive guide system 20 that aligns the top drive 18 with the wellbore 16 and prevents rotation of the top drive 18 during operation. The top drive 18 supports a drill pipe 24 that can be selectively coupled to a drill string 28 that is disposed in the wellbore 16.

In operation, the hoisting system (not shown) and top drive 18 are used to move drill pipe 24 from a storage area 26 to the wellbore 16 so as to increase or decrease the length of the drill string 28 within the wellbore 16. The top drive 18 includes a motor that provides the torque necessary to rotate the drill string 28 and a fluid conduit from the rig's pumping equipment (not shown) for circulating drilling fluids through the drill string 28.

Figure 2:
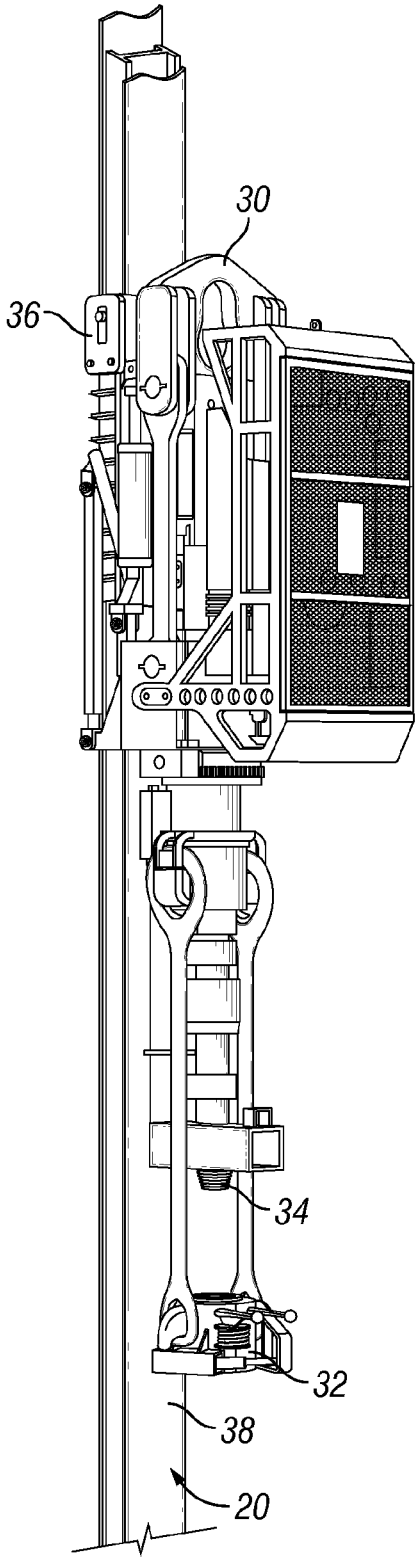
FIG. 2 is a partial view of a top drive unit mounted to a guide rail system.

FIG. 2 illustrates a more detailed view of a top drive 18 and a top drive guide system 20. Top drive 18 has an upper end that includes a bracket/bail 30 that couples to the traveling block 22 and a lower end with elevators 32 and a connection sub 34 for coupling to the drill pipe 24. The top drive 18 is mounted to a carriage or dolly 36 that is slidably coupled to a rail 38 of the top drive guide system 20. The top drive guide system 20 is constructed from a series of rail sections 38 connected to form a single elongate rail system that allows the top drive 18 to travel the height needed to support drilling operations. The length of the top drive guide system 20 is limited by the height and design of the derrick 12 and may be in excess of 200 feet. It is understood that the top drive system shown is merely illustrative and the concepts disclosed herein can be used with a variety of top drive systems.

To construct the top drive guide system 20, sections of rail 38 are delivered to the drilling rig 10 in lengths, such as between 20 and 40 feet, which are suitable for handling and transport. The individual sections of rail 38 are then hoisted into the derrick 12, with additional sections of rail 38 being coupled to the bottom of the assembled rail as the entire assembly is continuously hoisted into the derrick 12.

Figure 3A:
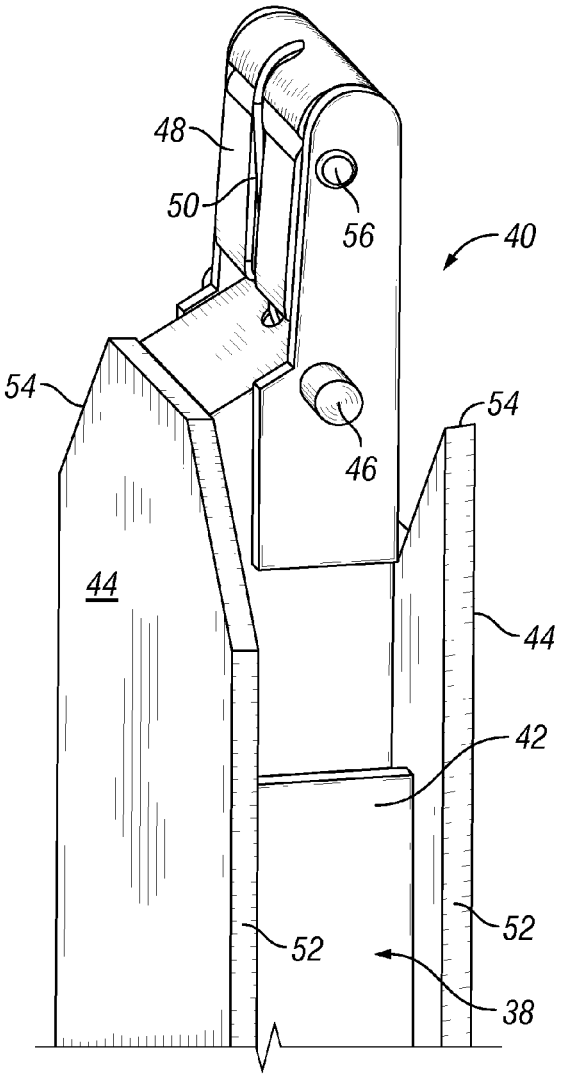
FIG. 3A is an upper end of a rail section shown in an unlocked position.
Figure 3B:
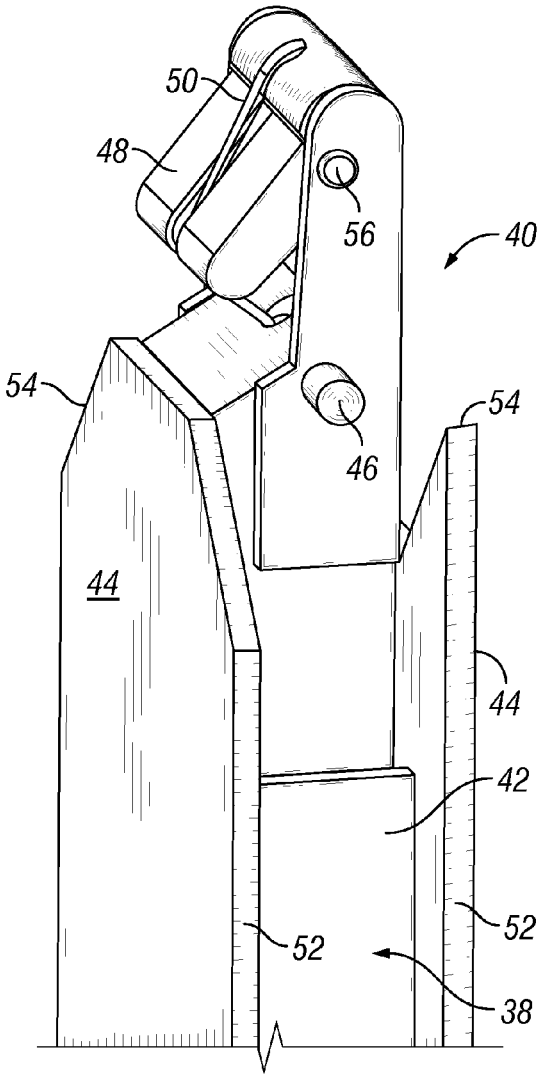
FIG. 3B is the upper end of the rail section of FIG. 3A shown in a locked position.

Referring now to FIGS. 3A and 3B, a first end 40 of a rail section 38 is shown. Rail section 38 includes a main beam 42, outer flanges 44, alignment pins 46, locking member 48, and actuation cable 50. Outer flanges 44 are fixedly coupled to the main beam 42 to form a structural member having the requisite strength to support a top drive (not shown). The edges 52 of the outer flanges 44 extend past the main beam 42 so as to form vertical flanges onto which the carriage of a top drive can be coupled. The ends 54 of the outer flanges 44 may also be shaped so as to cooperatively engage the abutting ends of adjacent rail sections 38.

The alignment pins 46 protrude from either side of the main beam 42 and are arranged to engage corresponding slots 60 (see FIGS. 4A and 4B) on the abutting end of adjacent rail sections 38. Locking member 48 is rotatably coupled to the main beam 42 by pins 56. Locking member 48 is biased to the locked position shown in FIG. 3B by a spring or other biasing member (not shown). Actuation cable 50 can be adjusted so that as tension is applied to the actuation cable, the biasing force on the locking member 50 is overcome and the locking member is rotated into the unlocked position as shown in FIG. 3A.

Figure 4A:
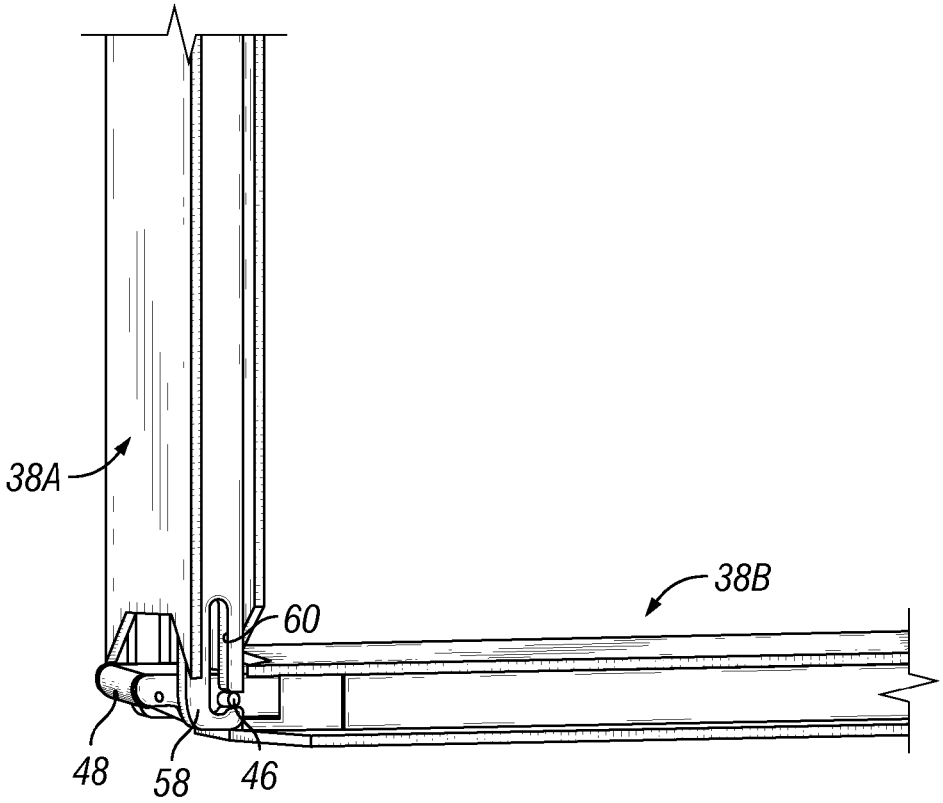
FIGS. 4A, 4B, 5A, 5B, 6, and 7 illustrate the assembly of two rail sections having a locking system.
Figure 4B:
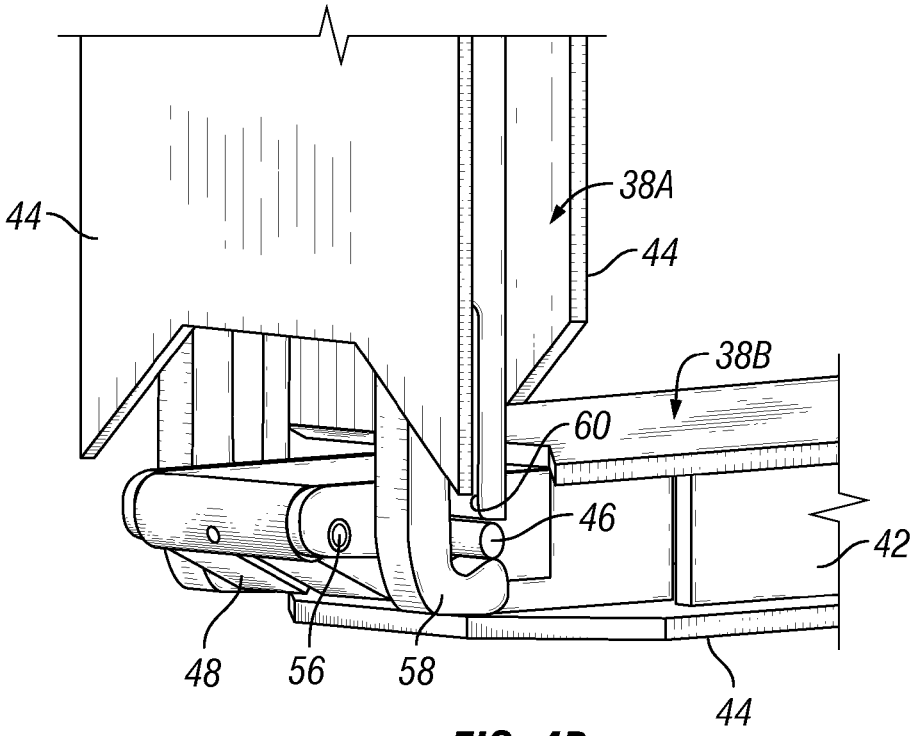

Referring now to FIGS. 4A and 4B, a first rail section 38A is supported vertically within the derrick (not shown) while a second rail section 38B is disposed substantially horizontally at or near the drill floor. The lower end of the vertical rail section 38A includes engagement arms 58 that extend from the end of the main beam 42 and are spaced to allow the upper end of the horizontal rail section 38B to fit there between. The alignment pins 46 of the horizontal rail section 38 are received into slots 60 formed in each engagement arm 58. Once the alignment pins 46 are engaged with the slots 60, the first rail section 38A can be hoisted within the derrick.

Figure 5A:
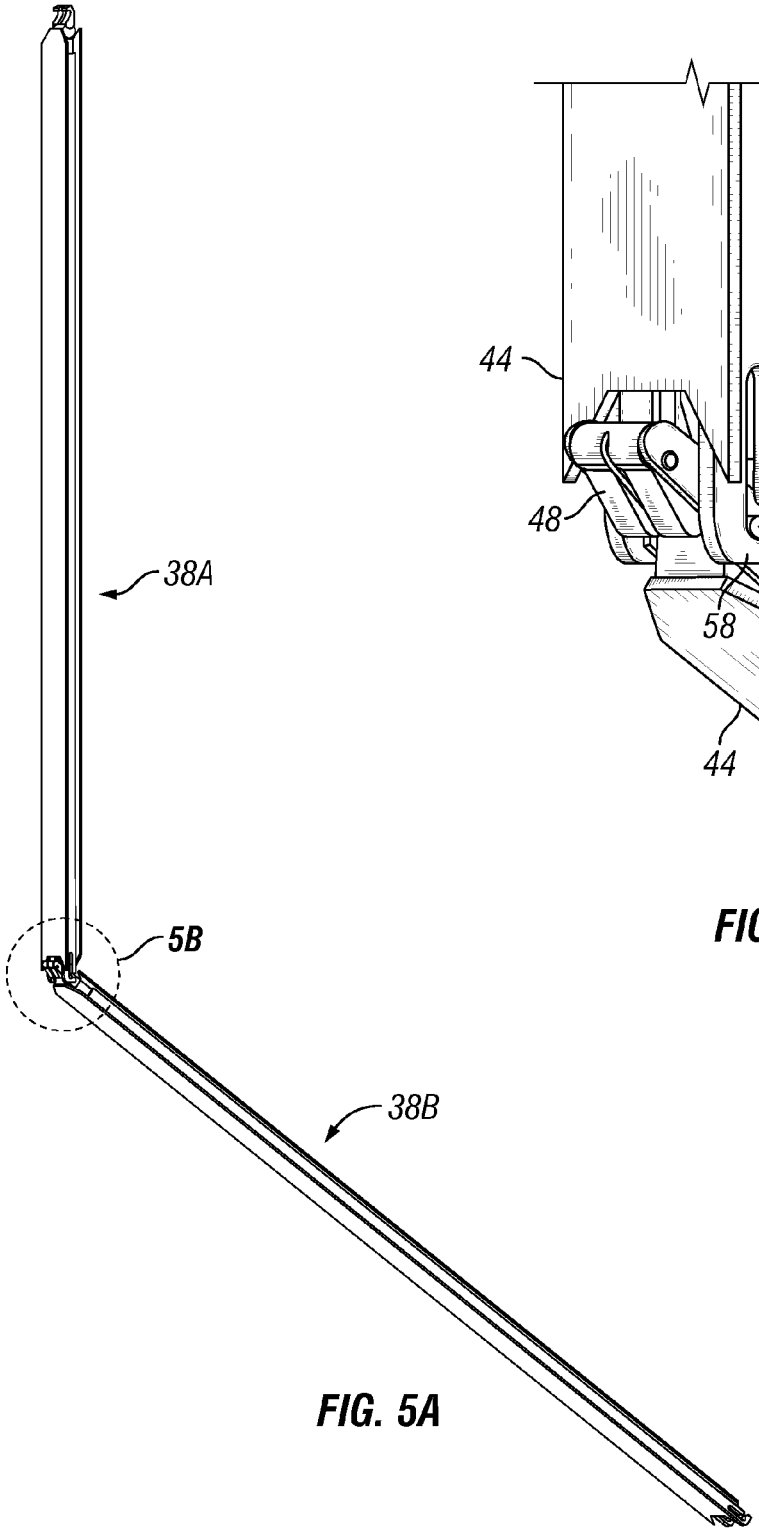
Figure 5B:
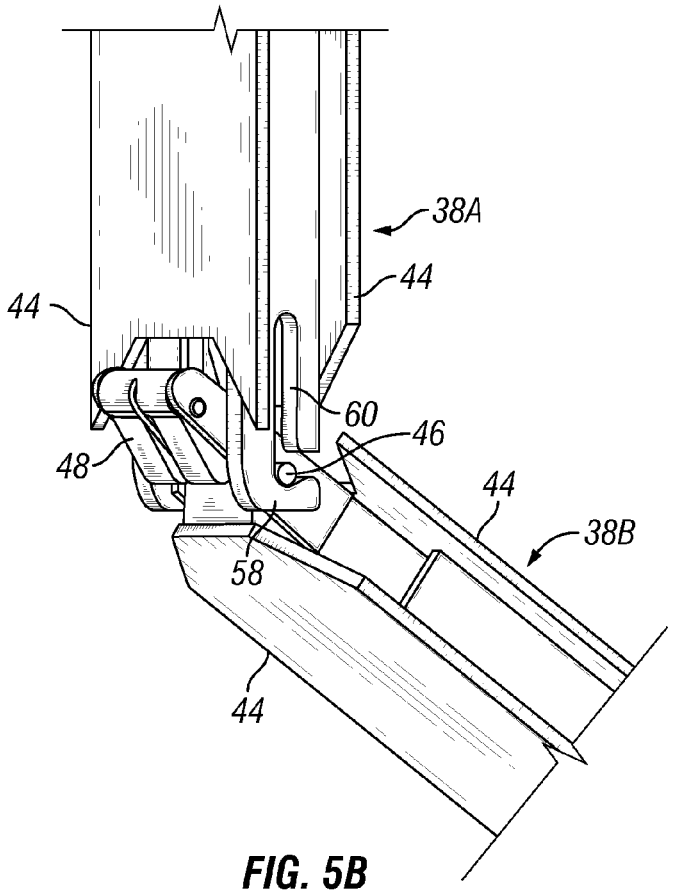
Figure 6:
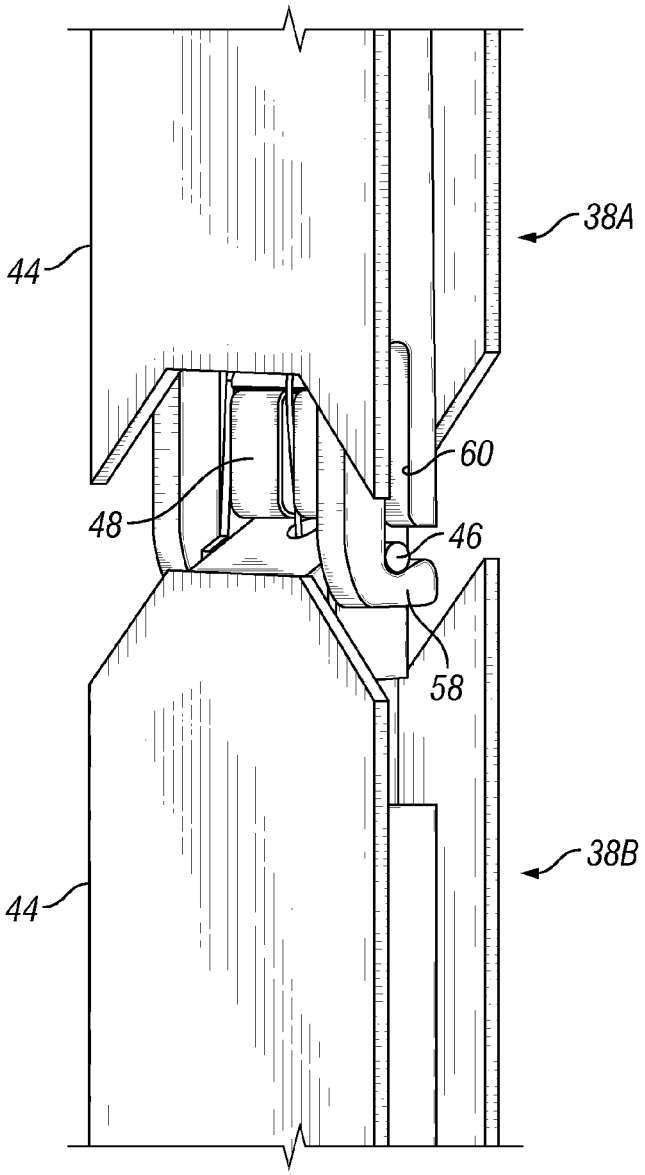
Figure 7:
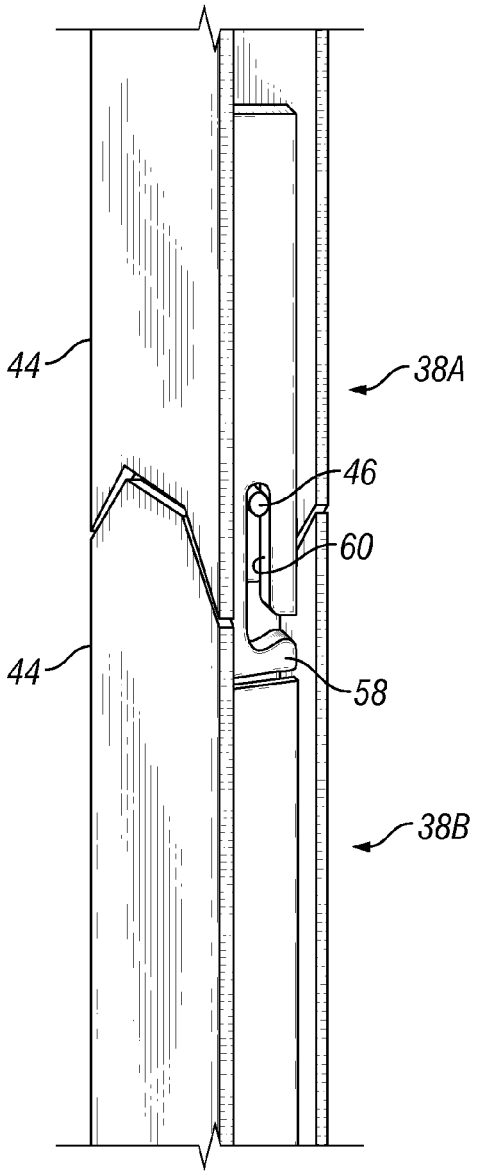

As the first rail section 38A is hoisted upward, the alignment pins 46 are captured by the lower end of the slots 60 and the second rail section 38B is lifted upward, as is shown in FIG. 5A and 5B. As the first rail section 38A is lifted, the second rail section 38B will pivot about the alignment pins 46 toward a vertical orientation, which is shown FIG. 6. Once the second rail section 38B is vertically aligned with the first rail section 38A, the two rails are lowered slightly so that the rail sections fully engage each other, as shown in FIG. 7.

Figure 8:
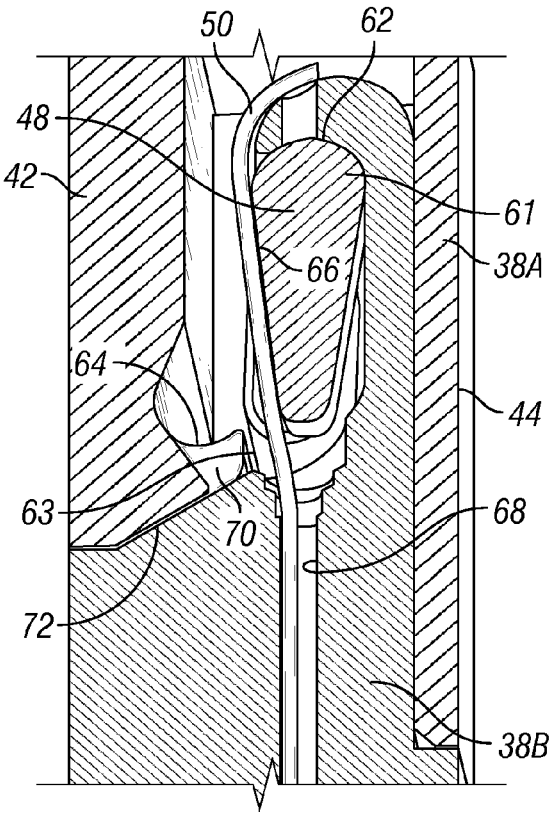
FIGS. 8-10 are partial sectional views of one embodiment of a locking system having a cable-actuated rotating locking member.
Figure 9:
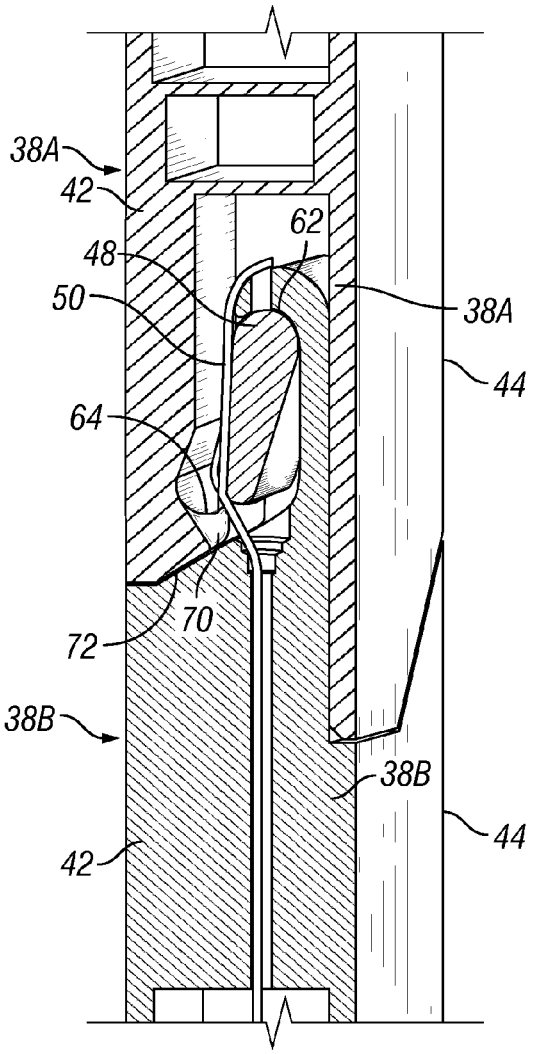
Figure 10:
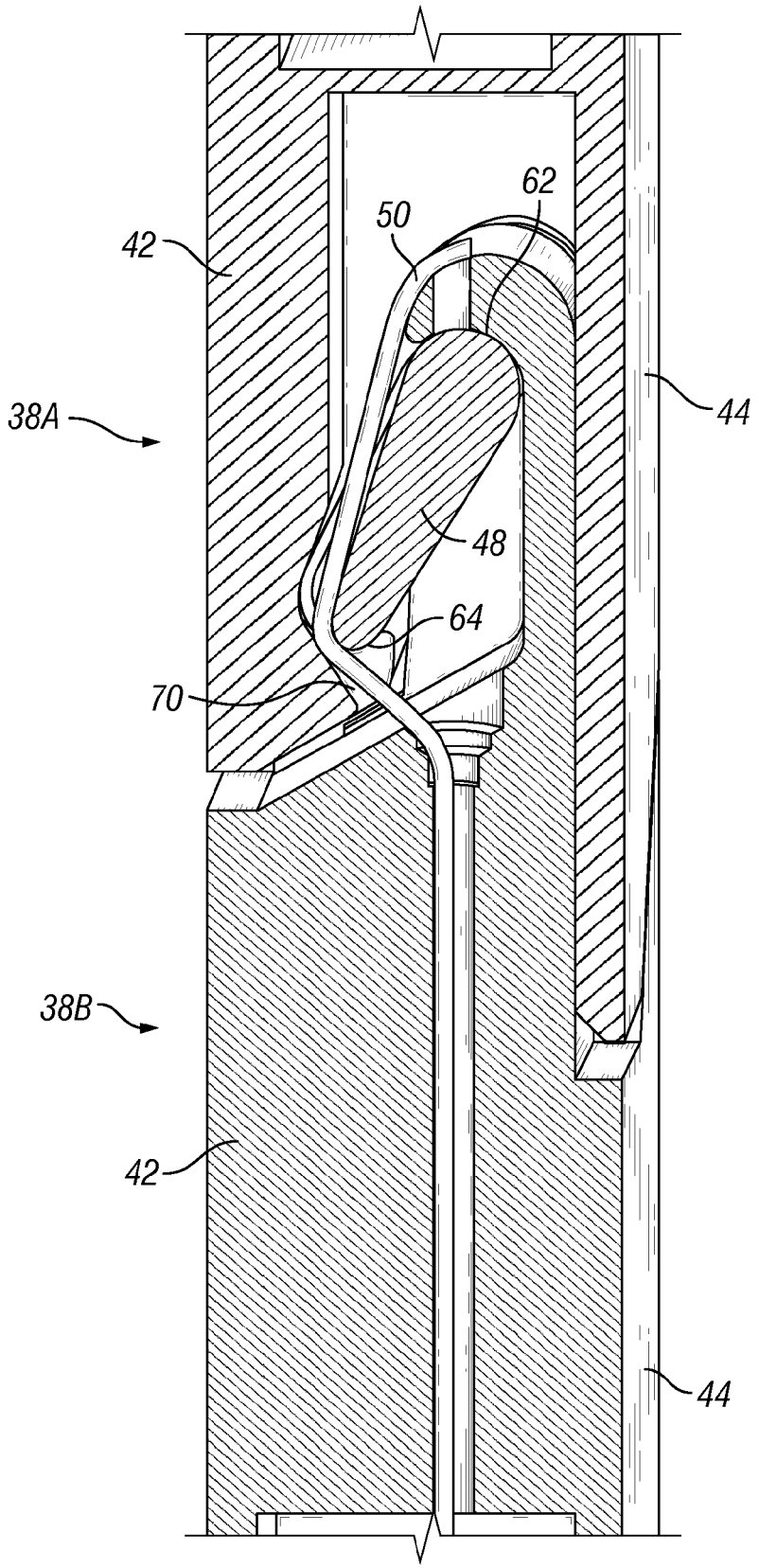

FIGS. 8-10 illustrate the actuation of the mechanism that couples the first rail section 38A to the second rail section 38B once the sections are fully engaged in a vertical orientation. In FIG. 8, the locking member 48, which is rotatably coupled to the second rail section 38B, is shown in a refracted position. The locking member 48 is supported on its upper end 61 by a curved slot 62 formed in the main body 42 of the second rail section 38B. The lower end 63 of the locking member 48 is shaped so as to be received into a corresponding locking shoulder 64 formed in the main body 42 of the first rail section 38A. The actuation cable 50 is coupled to the end of the second rail section 38B, extends through a slot 66 formed in the locking member 48 and into an aperture 68 through the main body 42 of the second rail section 38B. The actuation cable 50 exits the aperture 68 at or near the lower end of the second rail section 38B so that personnel on the drill floor can selectively apply tension to the actuation cable 50 as needed.

As previously discussed, the locking member 48 is biased to an extended position and can be held in the retracted position by applying tension to actuation cable 50. During assembly of the rail sections, the tension may be applied to the actuation cable 50, thereby keeping locking member 48 in the retracted position or the locking member 48 may be left in the extended position so that it automatically engages the first rail section 38A as the rail sections are assembled. The lower end of the first rail section 38A has an angled profile 72 that pushes the locking member 48 in slightly as it the rail sections are being engaged. For purposes of illustration, the engagement of the rail section will be described with the locking member 48 being initially in a refracted position.

Referring now to FIG. 8, the first rail section 38A and the second rail section 38B are fully engaged and the locking member 48 is in a refracted position. Releasing tension from the actuation cable 50 allows the locking member 48 to pivot so that the lower end 63 moves into engagement with locking shoulder 64 on the first rail section 38A. A slot 70 in the locking shoulder 64 receives the actuation cable 50 and the locking member 48 pivots outward to the position shown in FIG. 9.

The locking member 48 is shown in the locked position in FIG. 10. The lower end 63 of the locking member 48 is fully engaged with locking shoulder 64. Once the locking member 48 is in its locked position, the first rail section 38A can be hoisted in the derrick. As the rail now-connected rail sections 38A, 38B try to separate, the locking member 48 is captured between the curved slot 62 and the locking shoulder 63 and limits the relative axial movement of the rail sections. As long as the rail sections 38A, 38B are maintained in tension, either by their own weight, or by other means, the locking member 48 is fixed in place and cannot be rotated back to its refracted position.

In order to disassemble the rail sections 38A, 38B the above described procedure is reversed. The second rail section 38B is supported (such as on the drill floor) and moved upward relative to the first rail section 38A to the position shown in FIG. 9. Tension is applied to the actuation cable 50, which moves the locking member 48 to its retracted position as shown in FIG. 8. Once the locking member 48 is refracted, rail section 38A is lifted until the second rail section 38B is supported by the alignment pins 46 resting in supporting arms 58, as shown in FIG. 6. The second rail section 38B is then rotated about the alignment pins 46 to a horizontal position at or near the drill floor, the alignment pins 46 disengaged from the slots 60, and the rail sections separated.

Figure 11:
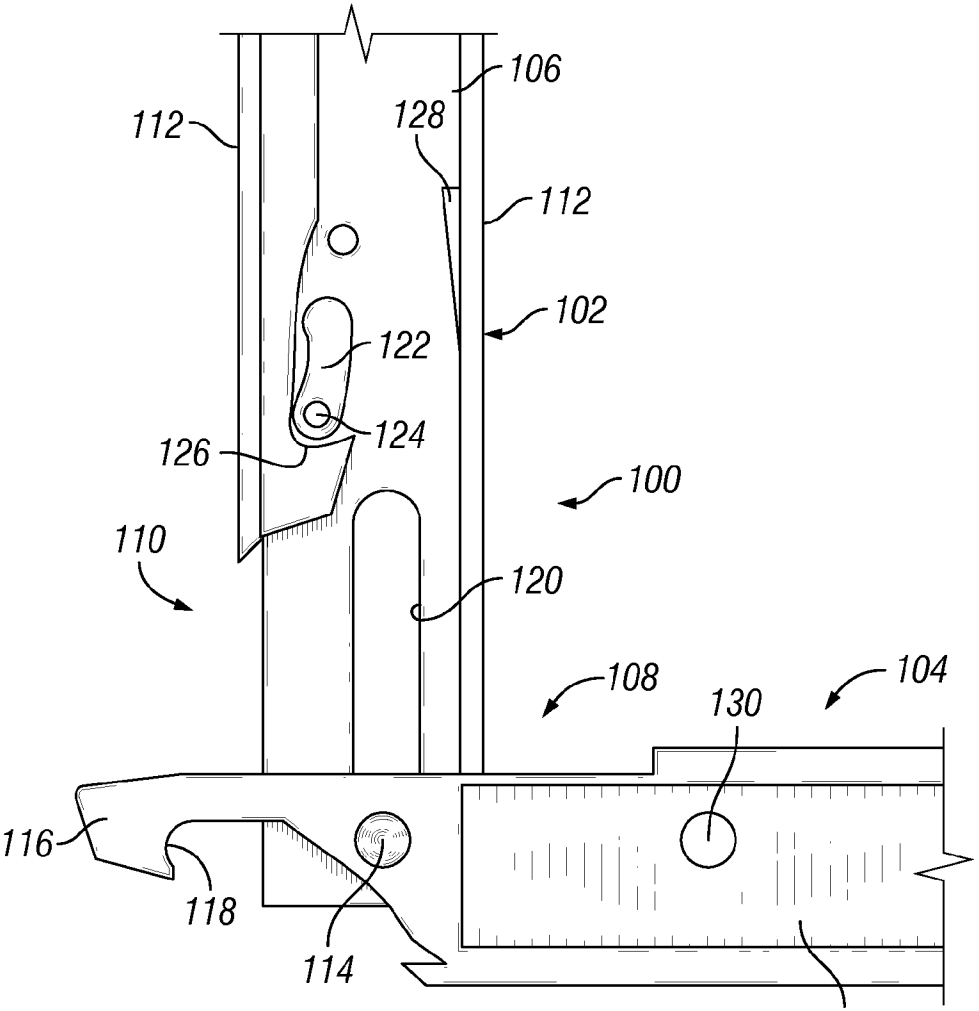

Referring now to FIG. 11, an alternative top drive guide system 100 is shown including a first rail section 102 and a second rail section 104. The first rail section 102 is suspended vertically in a derrick (not shown) and the second rail section 104 is in an initial position supported in a substantially horizontal position on the drill floor. The rail sections 102, 104 are substantially identical components having a main beam 106 with an upper end 108 and a lower end 110. In certain embodiments, the main beam 106 can include opposed flanges 112 that provide surfaces that guide a top drive. The upper end 108 of the rail sections 102, 104 includes an alignment pin 114, a locking arm 116, and a locking groove 118. The lower end 110 of the rail sections 102, 104 includes an alignment slot 120, a rotatable locking member 122, a pivot 124, and a locking groove 126.

The alignment slot 120 has an opening that allows alignment pin 114 to be inserted into the slot when the rail sections 102, 104 are substantially perpendicular to each other. During assembly of the top drive guide system 100, this occurs at or near the drill floor with the first rail section 102 suspended in the derrick and the second rail section 104 supported on or near the drill floor. Once the alignment pin 114 is disposed within the alignment slot 120, the first rail section 102 can be hoisted upward within the derrick.

Figure 12:
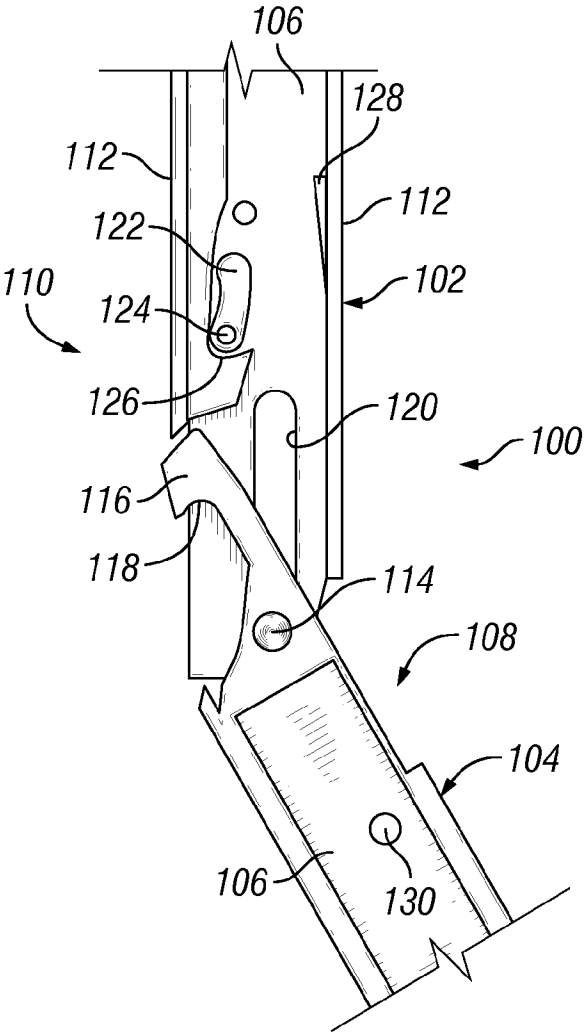
FIGS. 11-16 illustrate the assembly of two rail sections having an alternate rotating locking system.
Figure 13:
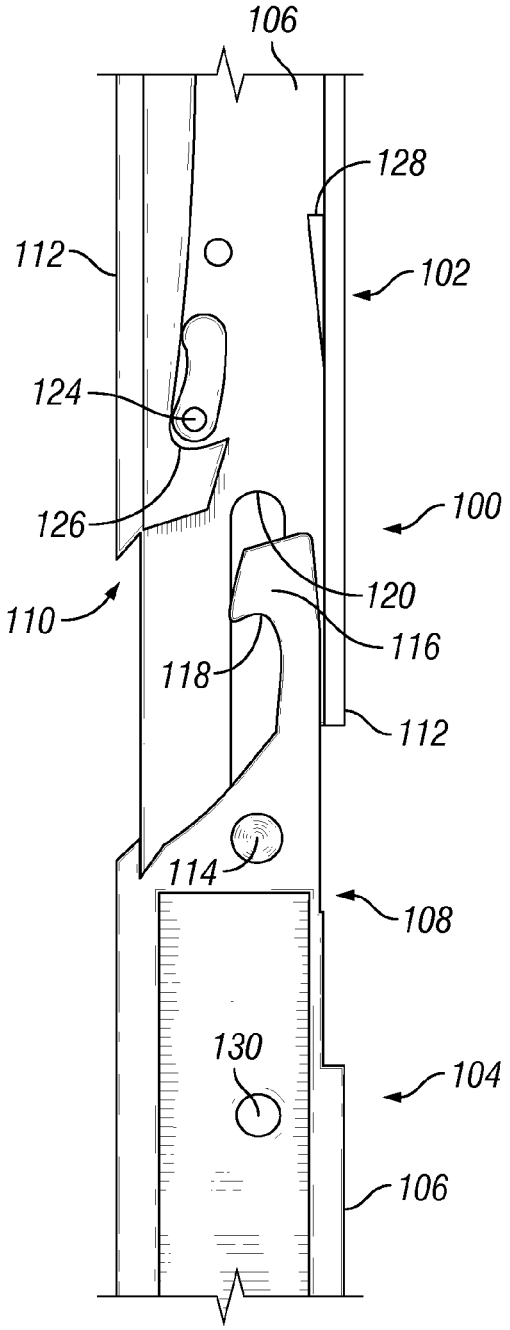

As shown in FIG. 12, as the first rail section 102 is hoisted upward, the upper end 108 of the second rail section 104 is lifted upward. As the upper end 108 is lifted, the second rail section 104 will rotate about the alignment pin 114 until the second rail section 104 is axially aligned with the first rail section 102, as is shown in FIG. 13. The locking arm 116 of the upper end 108 of the second rail section 104 will contact a flange 112 of the first rail section 102 and prevent the second rail section 104 from rotating past vertical.

Figure 14:
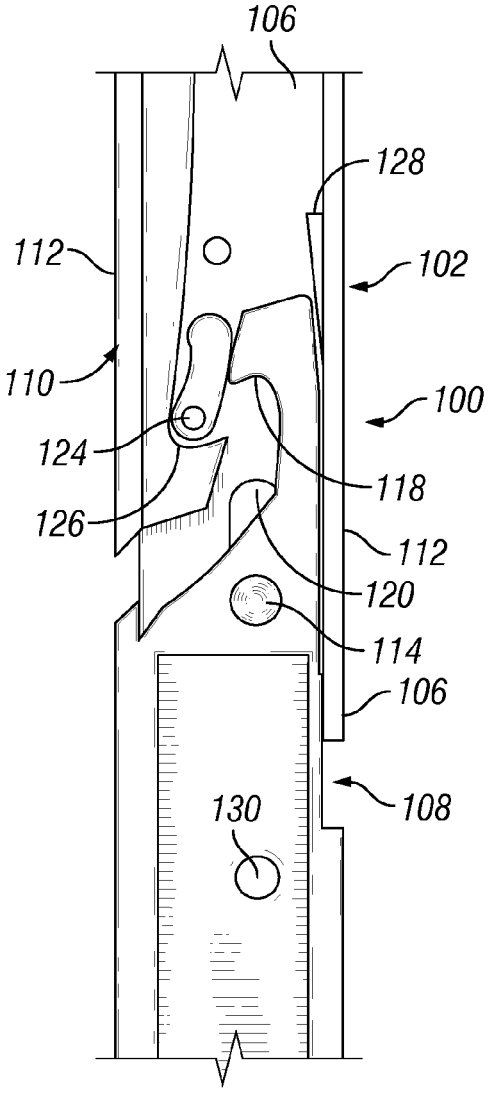

Once in the axially aligned position shown in FIG. 13, the rail sections 102, 104 are lowered back toward the drill floor. Lowering the rail sections allows the second rail section 104 to be at least partially supported by the drill floor so that it can be moved upward relative to the first rail section 102. As shown in FIG. 14, during this operation, the engagement of the alignment pin 114 and the alignment slot 120 as well as the contact between the alignment arm 116 and the flange 112 maintain the axial alignment of the rail sections 102, 104. As the second rail section 104 moves upward relative to the first rail section 102, the alignment pin 114 moves through the alignment slot 120.

Figure 15:
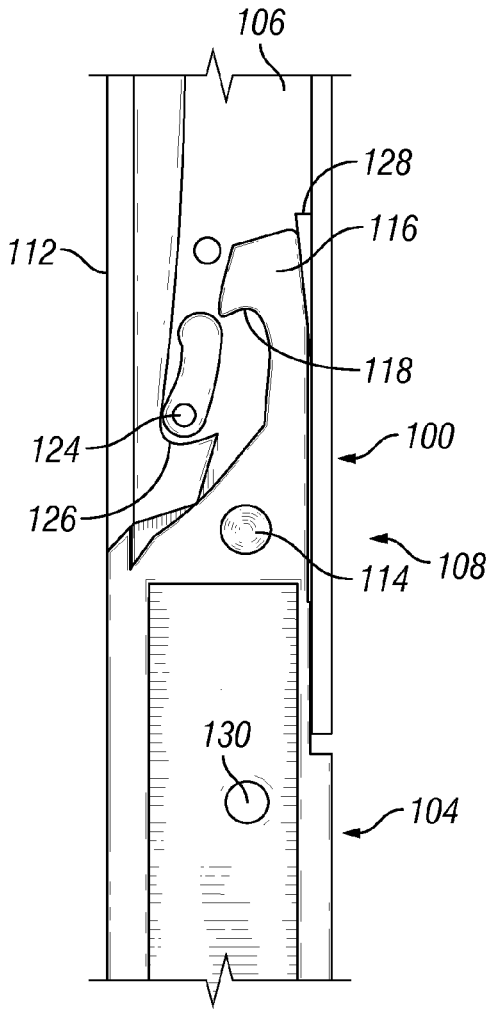

Referring now to FIG. 15, once the rail sections 102, 104 are fully engaged, aperture 130 is aligned with the alignment slot 120. In certain embodiments, a locking pin (not shown) can be inserted through the aperture 130 and alignment slot 120 to limit the axial movement of the rail sections 102, 104 relative to each other. The relative axial movement of the rail sections 102, 104 also moves the alignment arm 116 into position above the rotatable locking member 122. In certain embodiments, the alignment arm 116 has an angled, curved, or otherwise shaped leading edge that enables the alignment arm to easily move past the rotatable locking member 122.

Figure 16:
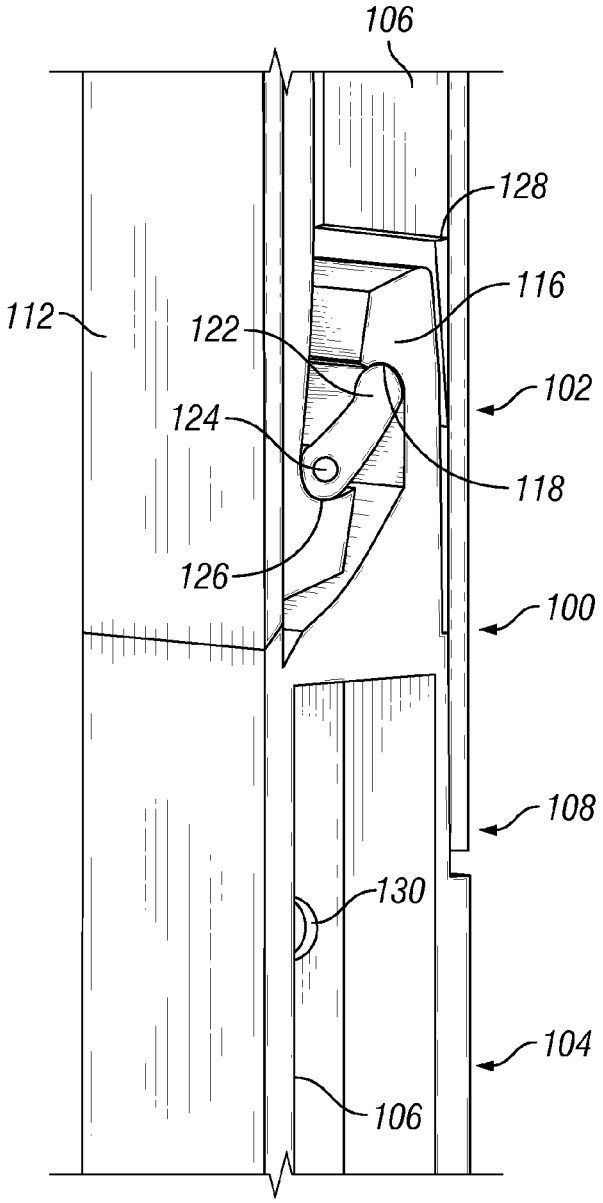

The locking member 122 can be rotated about pivot 124 to a locked position, as shown in FIG. 16, where the locking member is engaged with both locking grooves 118 and 126. Once in the locked position, the engagement of the locking member 122 between the locking grooves 188, 126 limits relative axial movement of the rail sections 102, 104. While the locking member 122 is in the locked position, the second rail section 104 is effectively coupled to the first rail section 102 and prevented from moving axially downward relative to the first rail section.

To disconnect the second rail section 104 from the first rail section 102, the second rail section 104 is moved upward relative to the first rail section 102. This can be accomplished by lowering the rail sections 102, 104 so that the second rail section 104 contacts and is supported by the drill floor. Once the second rail section 104 is moved slightly upward relative to the first rail section 102, the locking member 122 can be rotated to the unlocked position and the locking pin (if installed) can be removed from aperture 130. With the locking member 122 in the unlocked position, the rail sections 102, 104 can be separated and the guide system disassembled.

Figure 17A:
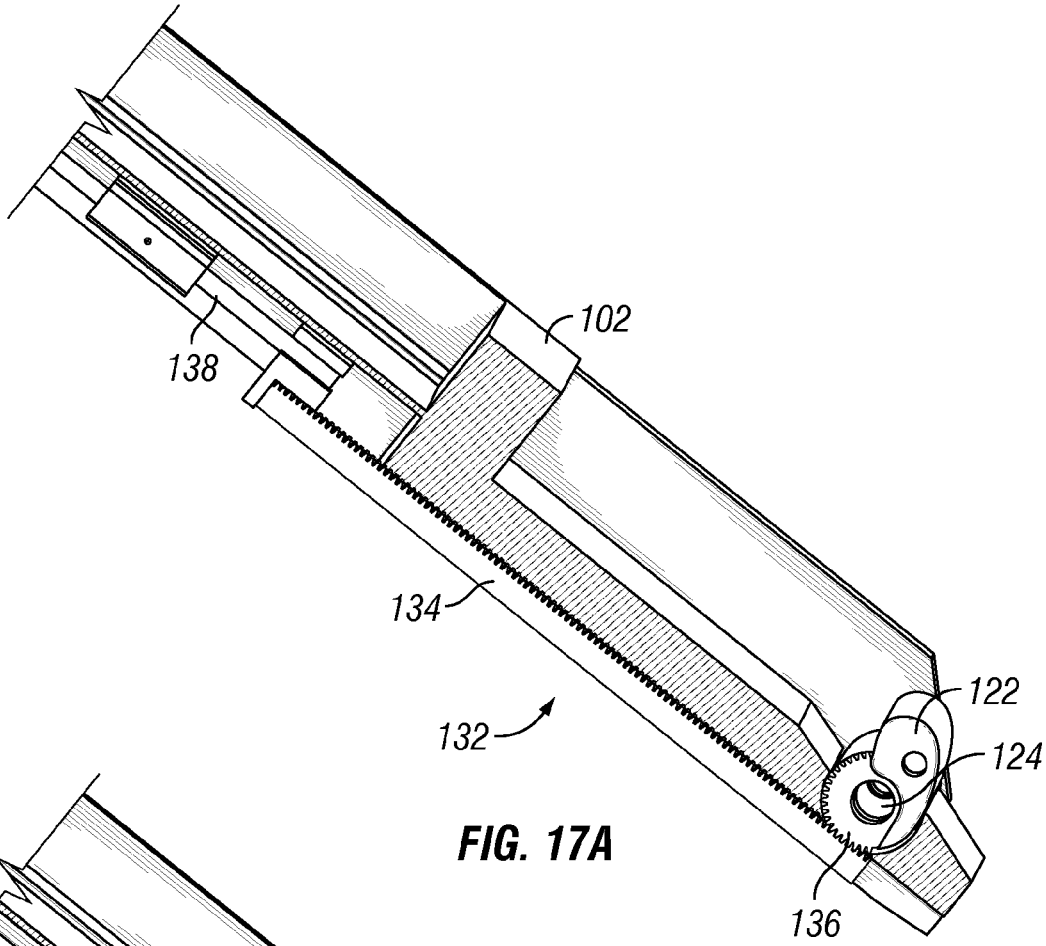
FIGS. 17A and 17B are partial sectional views of a locking system including a rack and pinion.
Figure 17B:
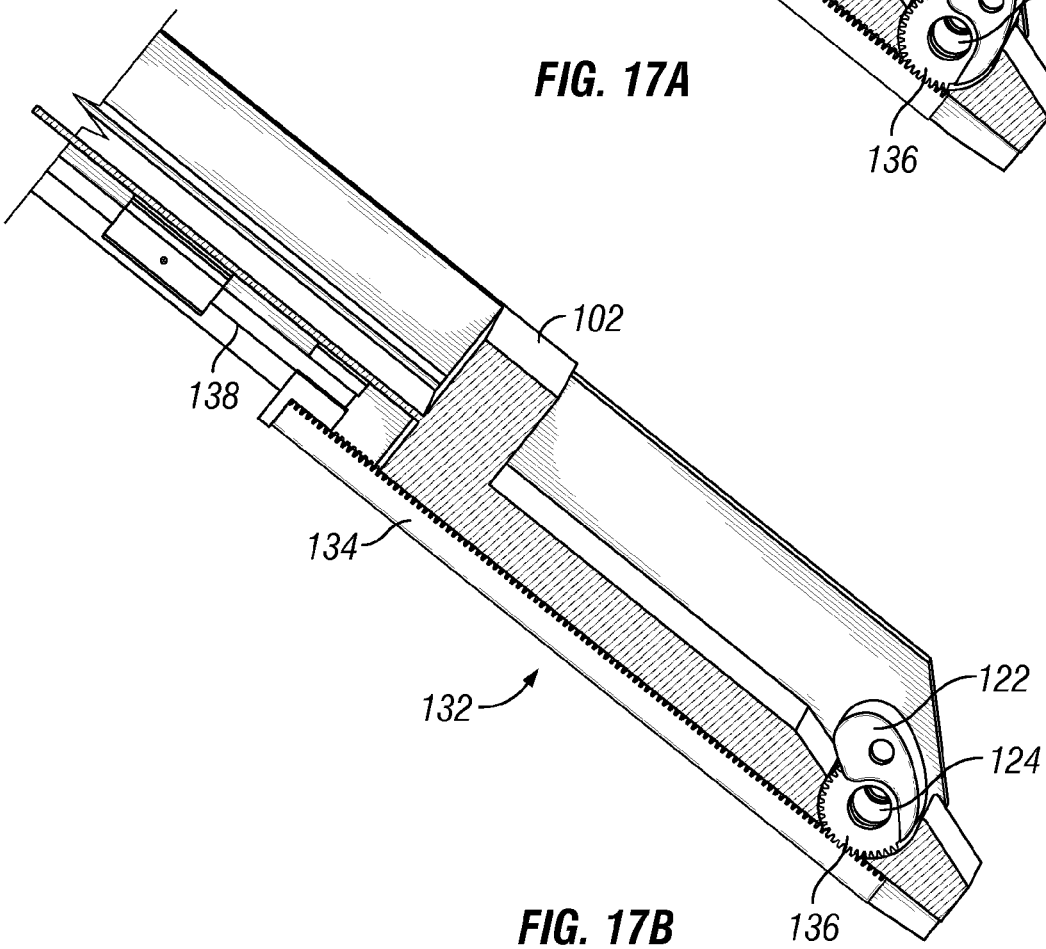

In order to move the locking member 122 between the locked and unlocked position, the rail sections 102, 104 can also, or in the alternative, include an actuation system 132 as shown in FIGS. 17A-17B. Actuation system 132 can include a geared rack 134 that is slidably coupled to the rail section 102 and a mating pinion 136 that is coupled to the locking member 122. As the geared rack 134 moves axially relative to the locking member 122, the pinion 136 and locking member 122 rotate about pivot 124.

Figure 18:
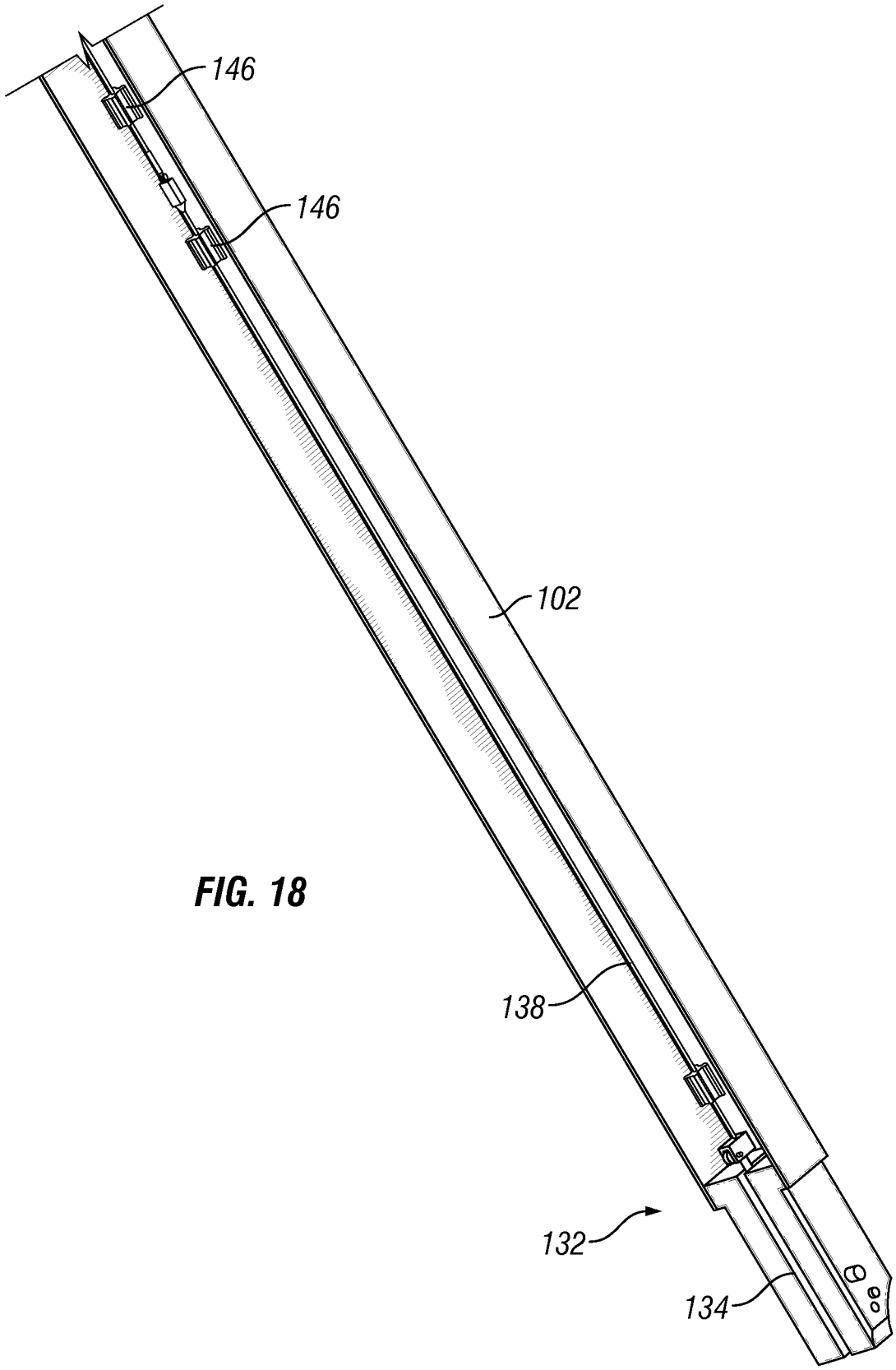
FIGS. 18-19 are partial sectional views of an alternate actuation mechanism for a locking system.
Figure 19:
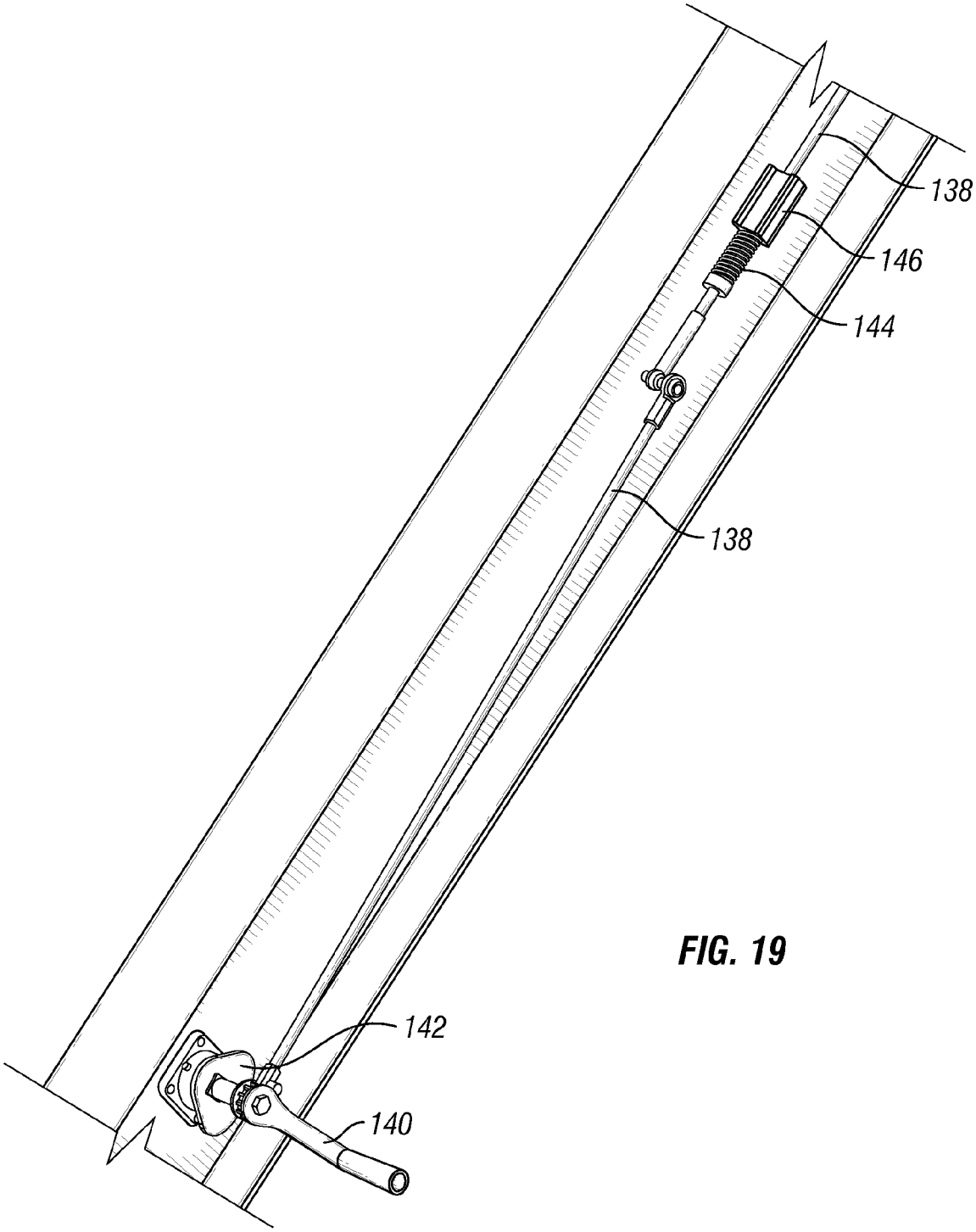

The geared rack 134 is coupled to an actuation rod 138 that is operable to move the rack relative to the rail section 102. Referring now to FIGS. 18 and 19, the actuation rod 138 is supported by bushings 146 and couples the geared rack 134 to an actuation cam 142. The actuation rod 138 is coupled to the actuation cam 142 in an off center position so that rotation of the cam causes the actuation rod to move axially relative to the rail section 102. In certain embodiments, the actuation cam 142 can be coupled to an actuation handle 140. In other embodiments, the actuation cam 142 can be coupled, either alternatively or in combination with an actuation handle 140, to cables, a motor, or some other device that is operable to rotate the cam. In certain embodiments, the actuation rod 138 can be coupled to other devices, such as a linear actuator, that can impart direct linear motion onto the rod.

Certain bushings 146 may include biasing members 144, such as a spring, that act to bias the actuation rod 138 toward a position that holds the locking member 122 in the locked position. In other embodiments, the locking member 122 may be biased to the locked position by a spring or other biasing member that imparts a torque on locking member 122 so as to rotate the locking member about pivot 126.

Figure 20:
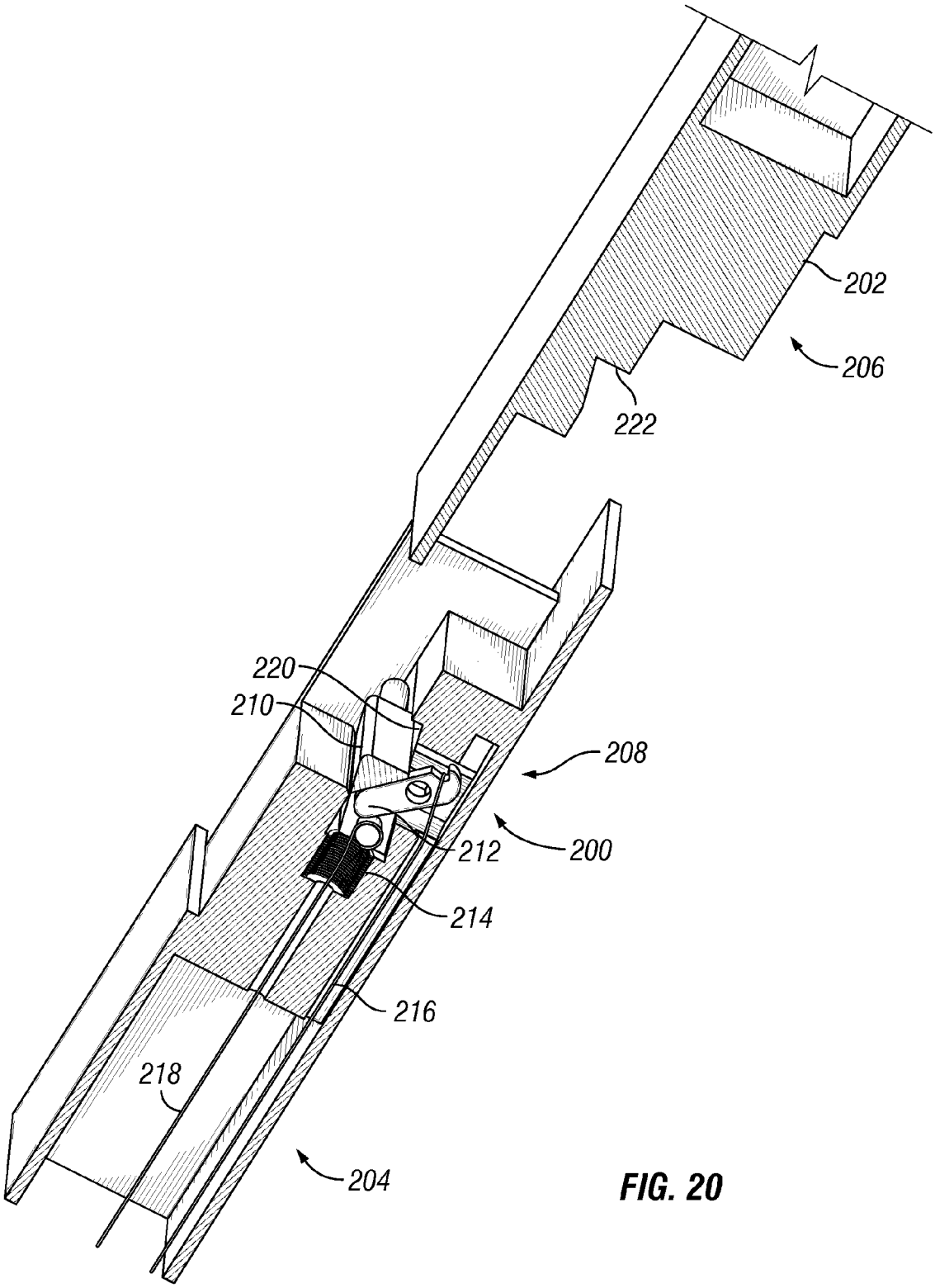
FIGS. 20-24 are partial sectional views of a locking system having a cable-actuated sliding locking member.
Figure 21:
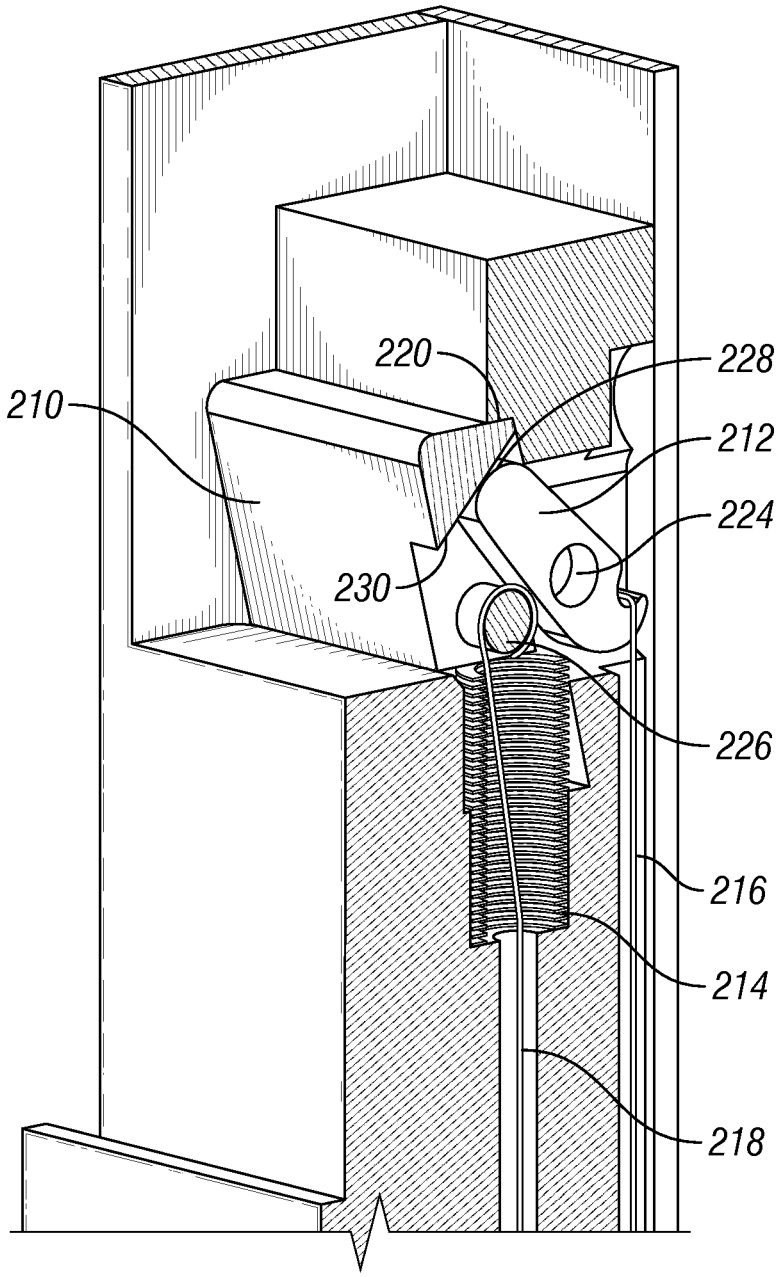
Figure 22:
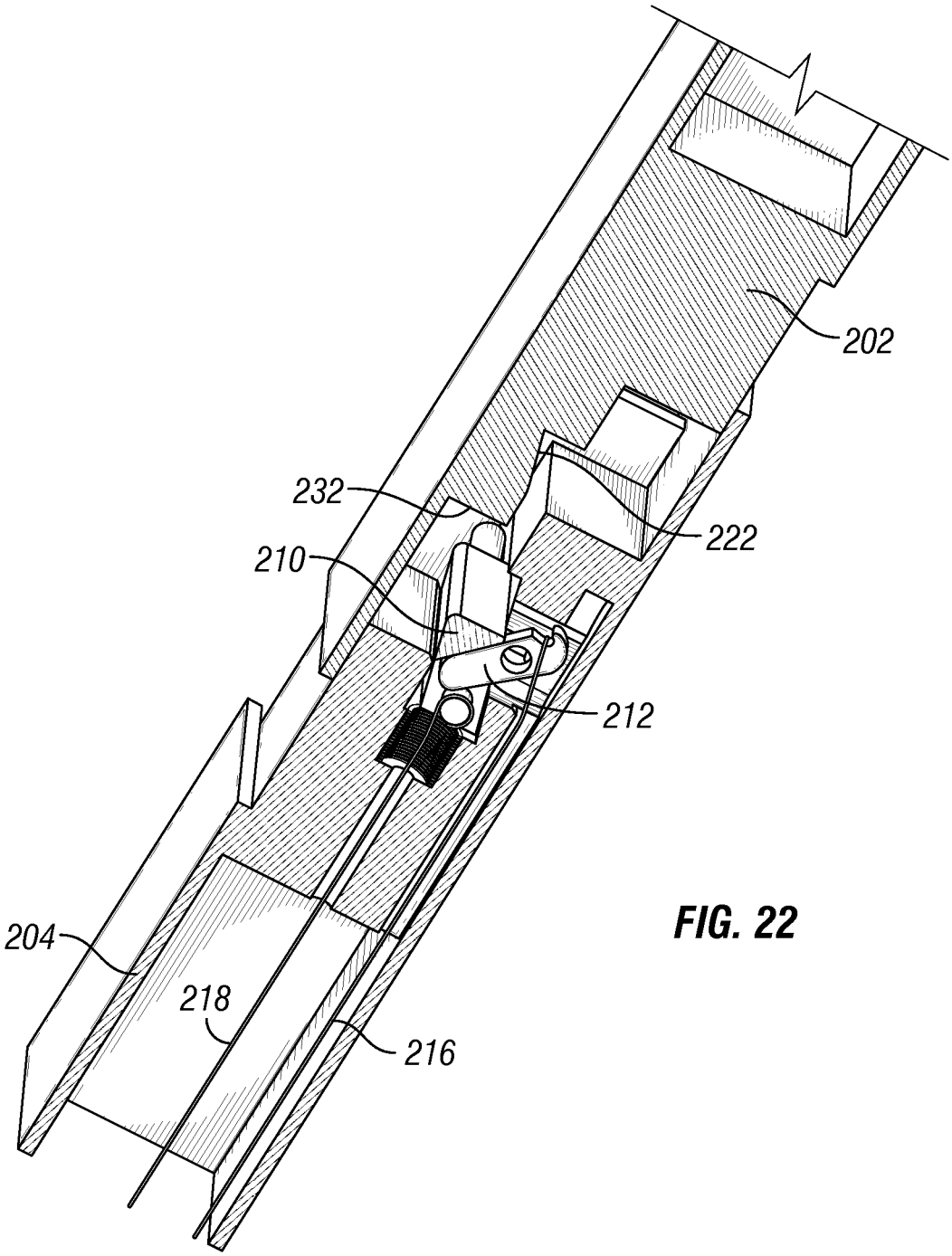

FIGS. 20-24 illustrate an alternative locking system 200 for coupling a first rail section 202 to a second rail section 204. The first rail section 202 has a receptacle end 206 that is operable to receive a locking assembly end 208 of the second rail section 204. The locking system 200 can be used with the hoisting and alignment systems and methods described above or can be used with other rail systems. The locking system 200 includes a translating locking member 210 that is slidably engaged with the second rail section 204 between an unlocked position (as shown in FIG. 20) and a locked position (as shown in FIG. 21).

Figure 24:
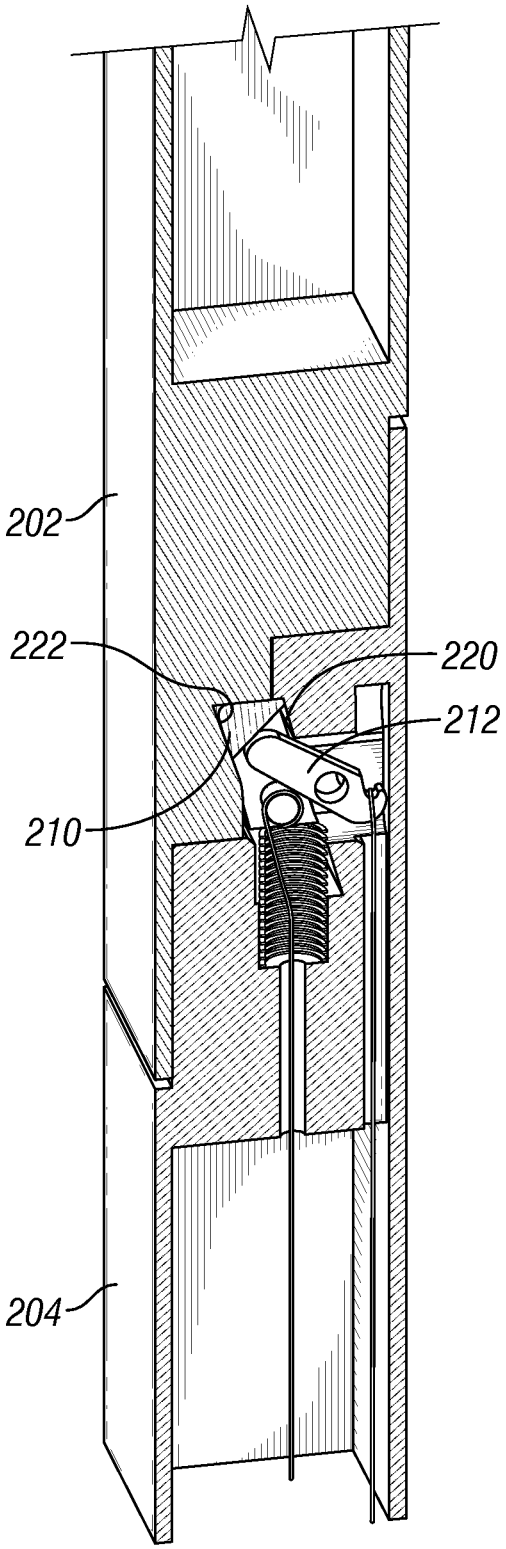

In certain embodiments, the locking member 210 is biased to the locked position by a spring 214, or other biasing member, disposed between the locking member 210 and the second rail section 204. The locking member 210 can also be moved to the locked position by an actuation arm 212 that is rotatably coupled to the rail section 204. An actuation cable 216 is coupled to the actuation arm 212 and extends through the second rail section 204. Applying tension to the actuation cable 216 rotates the actuation arm 212 so that the end 228 of the arm bears on an actuation face 230 of the locking member 210. The interaction between the end 228 of the actuation arm 212 and the actuation face 230 moves the locking member 201 upward relative to the rail section 204 and into the locked position, as shown in FIGS. 21 and 24.

Figure 23:
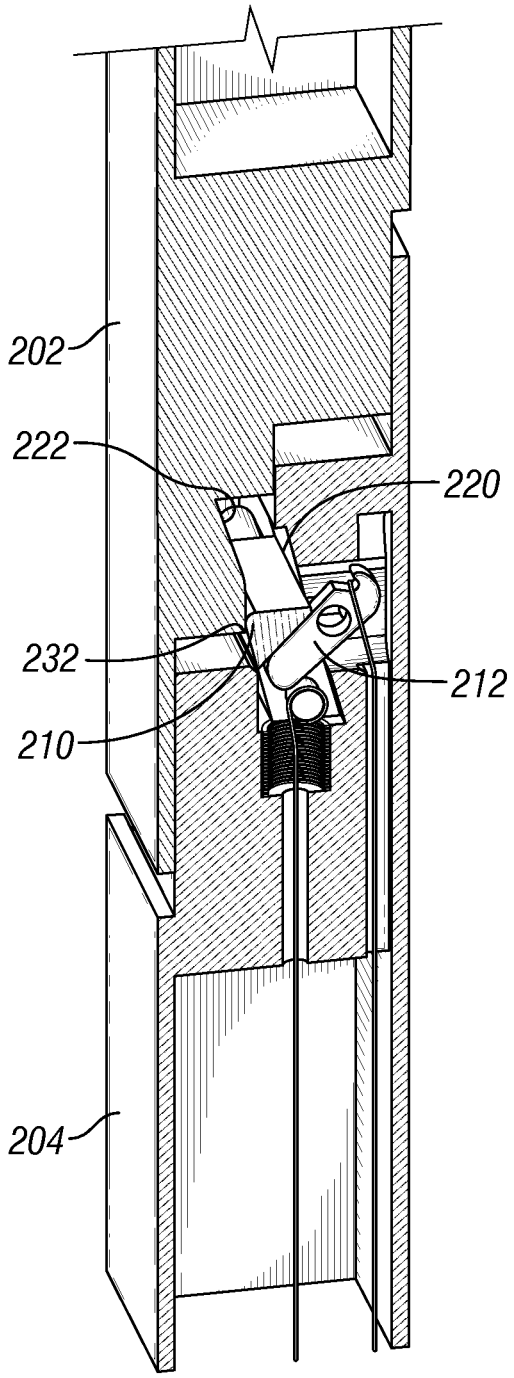

During assembly, the spring 214 maintains the locking member 210 in the locked position. As the two rail sections 202 and 204 are moved together, the locking member 210 can be moved partially toward the unlocked position by applying tension to the unlock cable 218 or can be pushed downward by contact with a guide shoulder 232 on the first rail section 202, as shown in FIG. 23. Once the rail sections are fully engaged, the locking member 210 is captured between locking surfaces 220 and 222. As shown in FIG. 24, with the locking member 210 in the locked position and tension applied to the rail sections 202, 204, the locking member 210 and locking surfaces 220, 222 limit the relative axial movement of the rail sections 202, 204.

To de-couple the rail sections 202, 204, the rail sections are moved back together axially. Once the rail sections 202, 204 are no longer in tension, the locking member 210 can be moved to the unlocked position, which will allow the sections to be separated. To move the locking member 210, an unlock cable 218 is coupled to the locking member and extends through the second rail section 204. Applying tension to the unlock cable 218 pulls the locking member 210 downward and compresses the spring 214. The continued application of tension to the unlock cable 218 will move the locking member 210 into an unlocked position as shown in FIG. 20. Once the locking member 210 is in the unlocked position, the rail sections 202, 204 can be separated from each other.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A top drive guide system comprising:

a first rail section having an upper end and a lower end;

a second rail section having an upper end coupled to the lower end of the first rail section;

a locking surface coupled to the lower end of the first rail section;

a locking member coupled to the upper end of the second rail section and movable between a locked position wherein the locking member is engaged with the locking surface and an unlocked position wherein the locking member is disengaged from the locking surface; and an actuator coupled to the locking member and operable to move the locking member from the locked position to the unlocked position, wherein the actuator extends from the locking member through the second rail section to the lower end of the second rail section.

2. The top drive guide system of claim 1, further comprising a biasing member that biases the locking member to the locked position.

3. The top drive guide system of claim 1, wherein the actuator is a cable.

4. The top drive guide system of claim 1, wherein the actuator is a rod.

5. The top drive guide system of claim 1, wherein the locking member is rotatably coupled to the second rail section.

6. The top drive guide system of claim 1, wherein the locking member is slidably coupled to the second rail section.

7. A top drive guide system comprising:

a top drive rail section;

a locking member moveably coupled to a first end of the top drive rail section;

a locking surface disposed on a second end of the top drive rail section;

an actuation member coupled to the locking member and operable to move the locking member from a locked position to an unlocked position, wherein the actuator extends from the locking member through the top drive rail section to the lower end of the top drive rail section; and a biasing member that biases the locking member to the locked position.

8. The top drive guide system of claim 7, wherein the actuation member is a cable.

9. The top drive guide system of claim 7, wherein the actuation member is a rod.

10. The top drive guide system of claim 7, wherein the locking member is rotatably coupled to the top drive rail section.

11. The top drive guide system of claim 7, wherein the locking member is slidably coupled to the second rail section.

12. A method of assembly a top drive guide system comprising:

suspending a first rail section vertically in a derrick;

disposing a second rail section in a horizontal position so that an upper end of the second rail section is adjacent to a lower end of the first rail section;

rotatably coupling the upper end of the second rail section to the lower end of the first rail section;

hoisting the first rail section so that the upper end of the second rail section is hoisted with the lower end of the first rail section and the second rail section rotates until the first and second rail sections are axially aligned;

lowering the first and second rail sections so that the second rail section moves axially upward relative to the first rail section until a locking member coupled to one of the rail sections engages a locking surface disposed on the other rail section so as to lock the first rail section to the second rail section; and hoisting the first and second rail sections.

13. The method of claim 12, further comprising:

disposing a lower end of the second rail section on the drill floor;

operating an actuator from the drill floor to move the locking member to an unlocked position that is disengaged from the locking surface so as to unlock the first rail section from the second rail section, wherein the upper end of the second rail section remains rotatably coupled to the lower end of the first rail section;

lifting the first rail section axially upward relative to the second rail section; and lowering the first and second rail sections while moving the lower end of the second rail section along the drill floor so that the second rail section rotates until the upper end of the second rail section is disposed on the drill floor; and decoupling the second rail section from the first rail section.

14. The method of claim 13, wherein the actuator is a cable.

15. The method of claim 13, wherein the actuator is a rod.

16. The method of claim 12, wherein a biasing member biases the locking member to the locked position.

17. The method of claim 12, wherein the locking member is rotatably coupled to the second rail section.

18. The method of claim 12, wherein the locking member is slidably coupled to the second rail section.

* * * * *

UNITED STATES PATENT AND TRADEMARK OFFICE

CERTIFICATE OF CORRECTION

PATENT NO. : 9,074,421 B2
APPLICATION NO. : 13/645988
DATED : July 7, 2015
INVENTOR(S) : Adrian Marica and Mihai Ionescu It is certified that error appears in the above-identified patent and that said Letters Patent is hereby corrected as shown below:

In the Claims

Column 8, line 16, in claim 7, the text "the actuator" should read --the actuator member--.

Column 8, line 18, in claim 7, the text "the lower end" should read --the second end--.

Signed and Sealed this
Seventeenth Day of May, 2016

Michelle K. Lee

Michelle K. Lee
*Director of the United States Patent and Trademark Office*